US010976133B2

(12) United States Patent
Hofmann et al.

(10) Patent No.: US 10,976,133 B2
(45) Date of Patent: Apr. 13, 2021

(54) DEVICE FOR ADJUSTING A RETICLE

(71) Applicant: STEINER-OPTIK GmbH, Bayreuth (DE)

(72) Inventors: Matthias Hofmann, Bayreuth (DE); Peter Haag, Bayreuth (DE)

(73) Assignee: STEINER-OPTIK GmbH, Bayreuth (DE)

( * ) Notice: Subject to any disclaimer, the term of this patent is extended or adjusted under 35 U.S.C. 154(b) by 0 days.

(21) Appl. No.: 16/487,025

(22) PCT Filed: Jan. 19, 2018

(86) PCT No.: PCT/EP2018/051262

§ 371 (c)(1),
(2) Date: Aug. 19, 2019

(87) PCT Pub. No.: WO2018/162132

PCT Pub. Date: Sep. 13, 2018

(65) Prior Publication Data

US 2020/0018569 A1 Jan. 16, 2020

(30) Foreign Application Priority Data

Mar. 7, 2017 (DE) ..... 102017104770.0

(51) Int. Cl.
*F41G 1/38* (2006.01)
*F41G 1/16* (2006.01)
*G05G 1/08* (2006.01)

(52) U.S. Cl.
CPC ..... *F41G 1/16* (2013.01); *F41G 1/38* (2013.01); *G05G 1/08* (2013.01)

(58) Field of Classification Search
CPC ..... F41G 1/16; F41G 1/18; F41G 1/20; F41G 1/22; F41G 1/28; F41G 1/38; G05G 5/03;
(Continued)

(56) References Cited

U.S. PATENT DOCUMENTS

2009/0044660 A1* 2/2009 Bonis ..... F41G 1/38 74/813 L
2009/0205461 A1* 8/2009 Windauer ..... F41G 3/06 74/553

(Continued)

FOREIGN PATENT DOCUMENTS

AT 514321 A4 12/2014
DE 102010060343 A1 5/2011

(Continued)

*Primary Examiner* — Richard W Ridley
*Assistant Examiner* — Brian J McGovern
(74) *Attorney, Agent, or Firm* — Rimôn, P.C.

(57) ABSTRACT

A device for adjusting a reticle, comprising: —an adjustable reticle, —an adjusting means set up to adjust the reticle, wherein the adjusting means includes an adjustment actuation element, movably mounted in an adjustment movement degree of freedom, —a blocking means assigned to the adjusting means set up to block movements of the adjustment actuation element, wherein the blocking means includes a blocking element transferrable into a blocking position, in which this effects that movements of the adjustment actuation element are blocked in the adjustment movement degree of freedom, and into an unblocking position, in which this effects that movements of the adjustment actuation element are not blocked in the adjustment movement degree of freedom, wherein the blocking element, in the blocking position, cooperates frictionally with the adjustment actuation element or with a component of the adjusting means coupled with the adjustment actuation element.

14 Claims, 3 Drawing Sheets

Figure 1:
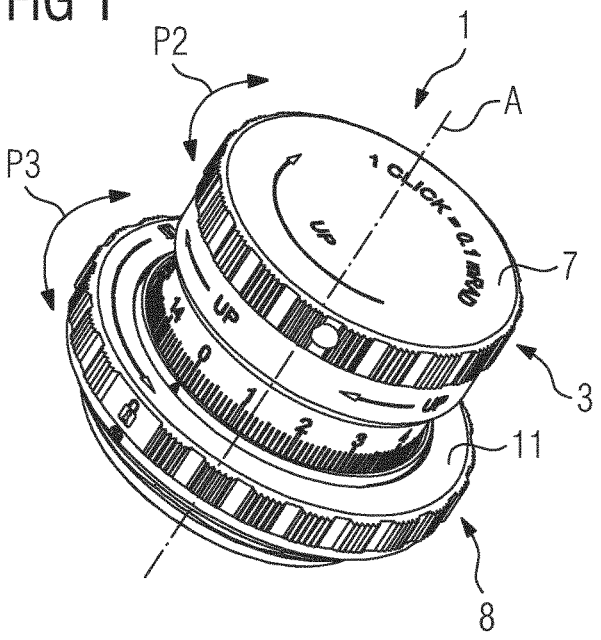

(58) Field of Classification Search
CPC ..... G05G 5/005; G05G 5/02; G05G 5/04; G05G 5/06; G05G 5/065; G05G 1/10; G05G 1/08; H01H 9/20
See application file for complete search history.

(56) References Cited

U.S. PATENT DOCUMENTS

| | | | | |
|---|---|---|---|---|
| 2011/0100152 | A1* | 5/2011 | Huynh | F41G 1/22 74/504 |
| 2013/0167425 | A1 | 7/2013 | Crispin | |
| 2013/0312310 | A1* | 11/2013 | Geller | F41G 1/38 42/122 |
| 2014/0196351 | A1* | 7/2014 | Campean | F41G 1/38 42/119 |
| 2016/0169672 | A1* | 6/2016 | Ottl | G02B 23/16 356/247 |
| 2018/0120058 | A1* | 5/2018 | White | F41G 3/00 |

FOREIGN PATENT DOCUMENTS

| | | | |
|---|---|---|---|
| DE | 202012012707 | U1 | 9/2013 |
| DE | 202014000102 | U1 | 2/2014 |
| EP | 3034982 | A1 | 6/2016 |

* cited by examiner

DEVICE FOR ADJUSTING A RETICLE

CROSS-REFERENCE TO RELATED APPLICATIONS

This application is a United States national stage entry of an International Application serial no. PCT/EP2018/051262 filed Jan. 19, 2018, which claims priority to German Patent Application serial no. 10 2017 104 770.0 filed Mar. 7, 2017. The contents of these applications are incorporated herein by reference in their entirety as if set forth verbatim.

The invention relates to a device for adjusting a reticle, including an adjustable reticle, an adjusting means, which is set up to adjust the reticle, wherein the adjusting means includes an adjustment actuation element to be actuated by a user for the adjustment of the reticle, movably mounted within a degree of freedom of adjustment movement, as well as a blocking means assigned to the adjusting means, which is set up to block a movement of the adjustment actuation element in the degree of freedom of adjustment movement, wherein the blocking means includes a blocking element transferrable into a blocking position, in which this element acts in such a manner that movements of the adjustment actuating element in the degree of freedom of adjustment movement is blocked, and into an unblocking position, in which this element acts in such a manner that movements of the adjustment actuation element in the degree of freedom of adjustment movement are not blocked.

Such devices for adjusting a reticle are known basically as components of telescopic devices, e.g. in the form of telescopic sight devices mounted or mountable on a firearm. The reticle of corresponding devices is adjustable in its position via an adjusting means, and thusly can be set to a specified shooting situation, i.e. in particular to a specified distance to target, and an actual hit point associated therewith. Here, assigning the adjusting means a blocking means is known, which is set up to block a movement of the adjustment actuation element, in order to secure a particular position of the reticle.

At times, corresponding blocking means are of complex structure in terms of function as well as in terms of construction, so that a demand exists for a device to adjust a reticle with a blocking means structured comparatively simply in functional as well as constructive regards, but nevertheless reliable.

The object of the invention is that of providing a device for adjusting a reticle with a blocking means comparatively simply both in terms of construction and function, but nevertheless reliable.

The object is achieved by a device for adjusting a reticle according to claim 1. The dependent claims relate to advantageous embodiments of the device.

The device described herein ("device") is set up to adjust the position of a reticle, i.e. a target marking, briefly to adjust a reticle, relative to a starting or reference position. The device can be configured as an adjustment turret of an adjustment turret unit or can form an integral part of a corresponding adjustment turret unit.

The device thus includes a reticle adjustable in its position and an adjusting means assigned to the reticle. The adjusting means is set up to adjust the reticle. The reticle is adjustable, typically in a linear, in particular horizontal or vertical movement axis (adjustment axis), via the adjusting means. The adjusting means is typically configured as an adjustment mechanism, or includes such, which is set up to convert a rotatory movement into a linear movement adjusting the reticle in a linear movement axis (adjustment axis).

The adjusting means typically includes two components cooperating to adjust the reticle. A first component of the adjusting means can be an adjustment element, mounted linearly movably, and motion-coupled with the reticle. The adjustment element can include a shaft-like adjustment section, movable against the reticle. An adjustment of the reticle can therefore occur through a movement of the adjustment section, occurring, if necessary, against a return force, configured through a suitable return element, i.e. e.g. a spring element, against the reticle. A second integral part of the adjusting means can be formed by a rotationally mounted transfer element. The transfer element is coupled with the adjustment element in such a manner that rotational movements of the transfer element are translatable or translated into linear movements of the adjustment element, in particular against the reticle. The coupling between the transfer element and the adjustment element can be formed through mechanical cooperating of transfer-element sided threaded elements and adjustment-element sided counter-threaded elements. The transfer-element sided threaded elements are typically internal threaded sections, formed in particular in the region of the inner circumference of a hollow-cylindrical transfer element section.

The adjustment-element sided counter-threaded elements are typically external threaded sections, formed in particular in the region of the outer circumference of a shaft-like adjustment element section.

The adjusting means further includes an adjustment actuation element, to be actuated by a user to adjust the reticle, movably mounted within a degree of freedom of adjustment movement. The adjustment actuation element is typically coupled co-rotationally, with the above-mentioned transfer element. The degree of freedom of adjustment movement typically is a degree of freedom of rotational movement, upon corresponding actuation of the user therefore typically rotational movements. The rotational axis typically corresponds to the central axis of the device defined through the rotationally symmetrical components of the device. The adjustment actuation element typically comprises a rotationally symmetrical, i.e. in particular an annular-type or shaped, or a shell-type or shaped or a hollow-cylinder-type or shaped basic geometric shape and is arranged coaxially to other components of the device.

The adjusting means is assigned a blocking means. The blocking means is set up for the (temporary) blocking of movements of the adjustment actuation element within the adjustment movement degree of freedom. The blocking means includes a blocking element transferrable into a blocking position and into an unblocking position. The blocking element is typically movably mounted between the blocking and the unblocking position. In the blocking position, the blocking element acts in such a manner that movements of the adjustment actuation element are blocked in the adjustment movement degree of freedom. In particular, the blocking element, in the blocking position, acts in such a manner upon the adjustment actuation device, that this device is not movable in the adjustment movement degree of freedom, consequently movements of the adjustment actuation element are not possible. In the unblocking position, the blocking element does not act in such a manner that movements of the adjustment actuation element in the adjustment movement degree of freedom are blocked. In particular, the blocking element, in the unblocking position, does not act upon the adjustment actuation element in such a manner that this element is not movable in the adjustment movement degree of freedom, consequently movements of the adjustment actuation element are not possible. The blocking element can comprise a rotationally symmetric, i.e. in particular an annular-type or shaped basic geometric shape, and be arranged coaxially to other components of the device.

What is essential is that the blocking element, in the blocking position, cooperates frictionally with the adjustment actuation element or with a component of the adjusting means (motion)—coupled with the adjustment actuation element. Through the frictional cooperation of the blocking element with the adjustment actuation element or, if present, the component of the adjusting means coupled with the adjustment actuation element, movements of the adjustment actuation element, in the adjustment movement degree of freedom, are blocked in the blocking position. Under a frictional cooperation of the blocking element with the adjustment actuation element, or of the component of the adjusting means coupled with the adjustment actuation element, in particular the configuration of a frictional force, acting, in particular in radial or circumferential direction with respect to a central axis of the device defined through the rotationally symmetrical components of the device, on the adjustment actuation element or the component of the adjusting means coupled with this adjustment actuation element is to be understood. The frictional force is typically so high that this force prevents movements of the adjustment actuation element in the adjustment movement degree of freedom, whereby the reticle is secured in its current position, and undesired adjustments of the reticle are suppressed. It is, however, also conceivable that the frictional force makes movements of the adjustment actuation element in the adjustment movement degree of freedom (considerably) more difficult in comparison to the unblocking position, whereby likewise-undesired adjustments of the reticle are suppressed.

The implementation of a blocking means with frictional-locking effect makes the implementation of a blocking means, structured comparatively simple both in terms of function an in terms of construction, but nevertheless reliable.

The blocking means can include a blocking actuation element, to be actuated by a user to transfer the blocking element from the blocking position into the unblocking position, or vice versa, movably mounted in a blocking movement degree of freedom. The blocking movement degree of freedom typically relates to a rotational movement degree of freedom, therefore in actuations of the user typically to rotational movements. The rotational axis typically corresponds to the central axis of the device defined through the rotationally symmetrical components of the device. The adjustment actuation element can have a rotationally symmetrical, i.e. in particular an annular-type or shaped basic geometric form and be arranged coaxially to other components of the device.

The blocking actuation element can be movably mounted between a first rotational (angle) position and/or a first axial position with respect to a central axis of the device, as mentioned, defined through the rotationally symmetrical components of the device, which first rotational position or first axial position correlates with the unblocking position of the blocking element, and a second rotational (angle) position and/or a second axial position with respect to the central axis of the device, which second rotational position or second axial position correlates with the blocking position of the blocking element. The blocking element permits itself hence to be transferred, by movements of the blocking actuating element, induced by user-sided actuations, between a first rotational (angle) position and a second rotational (angle) position and/or between a first axial position and a second axial position, into the blocking position or into the unblocking position.

A first axial position can be an upper position with respect to a horizontal plane, in particular defined by an exposed end face of the adjustment actuation element, and a second axial position can be a lower position with respect to the horizontal plane. Of course, in a reverse configuration, a first axial position can be a lower position with respect to a horizontal plane, in particular defined by an exposed end face of the adjustment actuation element, and a second axial position can be an upper position with respect to the horizontal plane.

It is also conceivable that the blocking actuation element is movably mounted between a first radial position with respect to the central axis of the device, which first radial position correlates with the unblocking position of the blocking element, and a second radial position with respect to the central axis of the device, which second radial position correlates with the blocking position of the blocking element. The blocking actuation element can here e.g. be configured as a radially movably mounted, in particular slide-like actuation element.

A first radial position can be a radially outer position with respect to the central axis of the device and a second radial position can be a radially inner position with respect to the central axis of the device. Of course, in a reverse configuration, a first radial position can be a radially inner position with respect to the central axis of the device and the second radial position can be a radially outer position with respect to the central axis of the device.

The blocking actuation element can include an effective surface, and the blocking element a counter-effective surface, wherein the blocking actuation element sided effective surface, through the moving of the blocking actuation element into the second rotational position and/or into the second axial position and/or into the second radial position cooperates with the blocking element sided counter-effective surface in such a manner that the blocking element is transferrable or is transferred from the unblocking position into the blocking position. The blocking actuation element sided effective surface and the blocking element sided counter-effective surface are consequently configured such that, through their cooperation, a frictional fit or the frictional force mentioned further above allows itself to be configured. The blocking actuation element sided effective surface is, in an actuation of the blocking actuation element, to transfer the blocking element into the blocking position, typically moved in an axial and/or radial direction relative to the blocking element sided counter-effective surface. As mentioned, the blocking actuation element, as well as the blocking element, can be configured rotationally symmetrical, i.e. in particular annular-type or ring-shaped and be coaxially arranged; the blocking actuation element sided effective surface can here be arranged or configured on a section of the inner circumference of the blocking actuation element, the blocking element sided counter-effective surface can be arranged or configured on a section of the outer circumference of the blocking element. In principle, a reversed configuration is also possible here.

The blocking actuation element sided effective surface can, through movement of the blocking actuation element into the second rotational (angle) position and/or into the second axial position and/or into the second radial position, cooperate in such a manner with the blocking element sided counter-effective surface, that the blocking element is transferrable from the unblocking position into the blocking position, in that the blocking element is or will be moved in a radial direction with respect to the central axis of the device while configuring a frictional fit against the adjustment actuation element or the component of the adjusting means coupled with the adjustment actuation element. As mentioned, the blocking actuation element sided effective surface, in an actuation of the blocking actuation element to transfer the blocking element into the blocking position, is typically moved relative to the blocking element sided counter-effective surface; this relative movement, due to the geometrically-constructive shape of the effective and counter-effective surface, causes a radially inwardly directed movement or deformation of the blocking element, with respect to the central axis of the device, adjustment actuation element or the component of the adjusting means coupled with the adjustment actuation element.

The blocking element can thusly be configured elastically-resiliently or reversibly deformable in a radial direction, with respect to the central axis of the device, wherein the blocking element is transferrable from a first deformation state correlated with the unblocking position into a second deformation state correlated with the blocking position, in which state the blocking element is radially inwardly deformed in comparison to the first deformation state with respect to the central axis of the device. The blocking element, in the first deformation state, is typically less deformed than in the second deformation state. The first deformation state can also correspond to a non-deformation state, in which the blocking element is not deformed. The elastically resilient or reversibly deformable features of the blocking element can e.g. be achieved through a suitable material selection and/or through suitable geometrically constructive measures, i.e. e.g. the targeted introduction of slits, generally of weakenings.

The blocking actuation element sided effective surface can be configured as a cone surface, i.e. as a conically extending surface or include such. The blocking element sided counter-effective surface can be configured as a counter-conical surface (geometrically) corresponding to the cone surface, i.e. as a (geometrically) conically extending surface corresponding to the conically extending surface, or include such. The blocking actuation element sided effective surface is moved, in an actuation of the blocking actuation element, to transfer the blocking element into the blocking position typically relative to the blocking element sided counter-effective surface, this relative movement causes, due to the corresponding conical shape of the effective and counter-effective surface, the described movement directed radially inwardly with respect to the central axis of the device or deformation of the blocking element against the adjustment actuation element or the component of the adjusting means coupled with the adjustment actuation element.

The blocking element can friction-fittingly cooperate, in the blocking position, via a blocking surface element arranged on the blocking element, or e.g. configured in one piece, with a counter-blocking surface element arranged on the adjustment actuation element or the component of the adjusting means coupled with the adjustment actuation element, or, e.g. configured as one piece. Through the cooperation of the blocking element sided blocking surface element with the adjustment actuation element sided or the component sided counter-blocking surface element, the actual configuration of the mentioned frictional force occurs. Consequently, the blocking element sided blocking surface element and the adjustment actuation element sided or the component sided counter-blocking surface element is configured with respect to the configuration of a corresponding frictional force. As mentioned, the blocking actuation element, as well as the blocking element can be configured rotationally symmetrically, i.e. in particular annularly or ring-shaped and be coaxially arranged; the blocking element sided blocking surface element can here be arranged or configured on a section of the inner circumference of the blocking element, the adjustment actuation element sided or component-sided counter-blocking surface element can be arranged or configured on a section of the outer circumference of the adjustment actuation element or of the component coupled with the adjustment actuation element.

The blocking surface element arranged or configured on the blocking element can, at least in sections, in particularly completely, be configured of an elastomeric, in particular rubber-like material. A configuration from a synthetic material or metal is also conceivable. The counter-blocking surface element arranged or formed on the adjustment actuation element of the adjusting means or the component coupled with the adjustment actuation element can, at least in sections, in particularly completely, be formed with a friction-increasing surface structure, in particular a knurling structure. A reversed configuration is, of course, just as conceivable.

The blocking actuation element can be mounted, via a coupling element, coupled with the same in a rotationally fixed manner, movably mounted relative to a positionally-fixed mounting element of the device between a first axial position with respect to the central axis of the device, which first axial position correlates with the unblocking position of the blocking element, and a second axial position with respect to the central axis of the device, which second axial position correlates with the blocking position of the blocking element, on the positionally-fixed base member of the device. The coupling element can be rotationally symmetrically, i.e. in particular configured ring-type or shaped, and be arranged coaxially to other components of the device. The likewise, if necessary rotationally symmetrically configured blocking actuation element can, e.g. be arranged or configured coupled, rotationally-fixed, on the outer circumference of the coupling element. The mounting element is set up for mounting the device on a long-range optical unit, i.e. in particular a telescopic sight means, and includes a number of suitable mounting interfaces for this purpose. Corresponding mounting interfaces can be mounting bores penetratable e.g. by a mounting element, i.e. e.g. a mounting screw.

Along with the device, the invention also relates to a long-range optical unit. The long-range optical unit in particular serves to optically magnify objects observed in the distance through the same. For this purpose, the long-range optical unit includes multiple optical, i.e. in particular optically magnifying elements arranged between an object lens and an eyepiece. The optical elements, which can e.g. relate to lenses or prisms, form an optical channel. The long-range optical unit e.g. relates to a telescopic sight means mountable or to be mounted on a gun or firearm, such as e.g. on a rifle.

The long-range optical unit includes at least one device, as described, to adjust a reticle. All embodiments in conjunction with the device also thusly apply analogously for the long-range optical unit. The reticle is arranged in the optical channel of the long-range optical unit formed through the optical elements. The reticle is adjustable in its position (inside the optical channel), and thusly permits itself to be set to a specified shooting situation, i.e. in particular to a specified distance to target, and a therewith connected actual hit point. Under a position adjustment of the reticle, in particular an adjustment of the horizontal and/or vertical position of the reticle, in particular with respect to a horizontal and/or vertical starting or reference position is to be understood.

Figure 2:
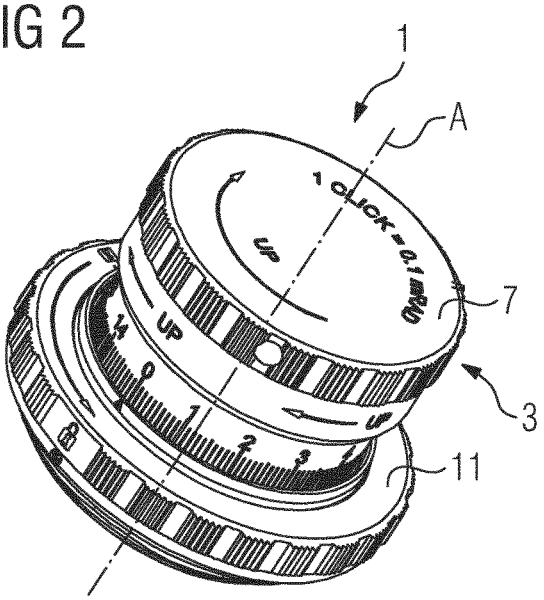
Figure 3:
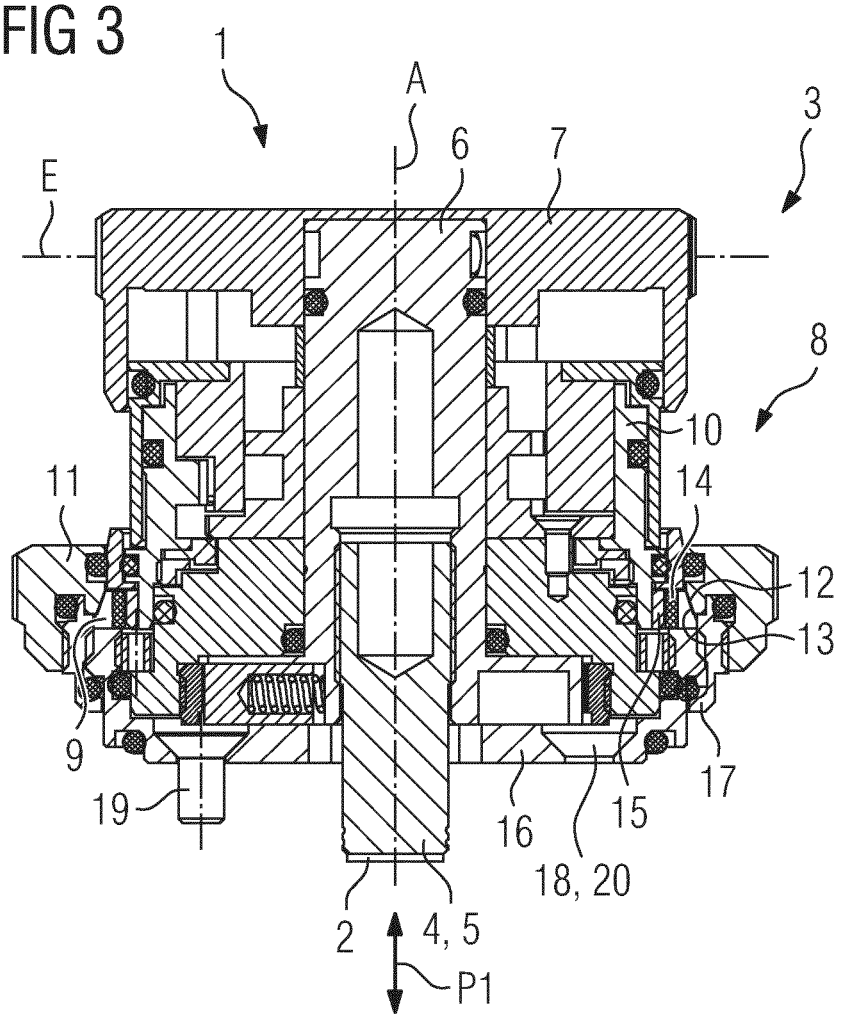
Figure 4:
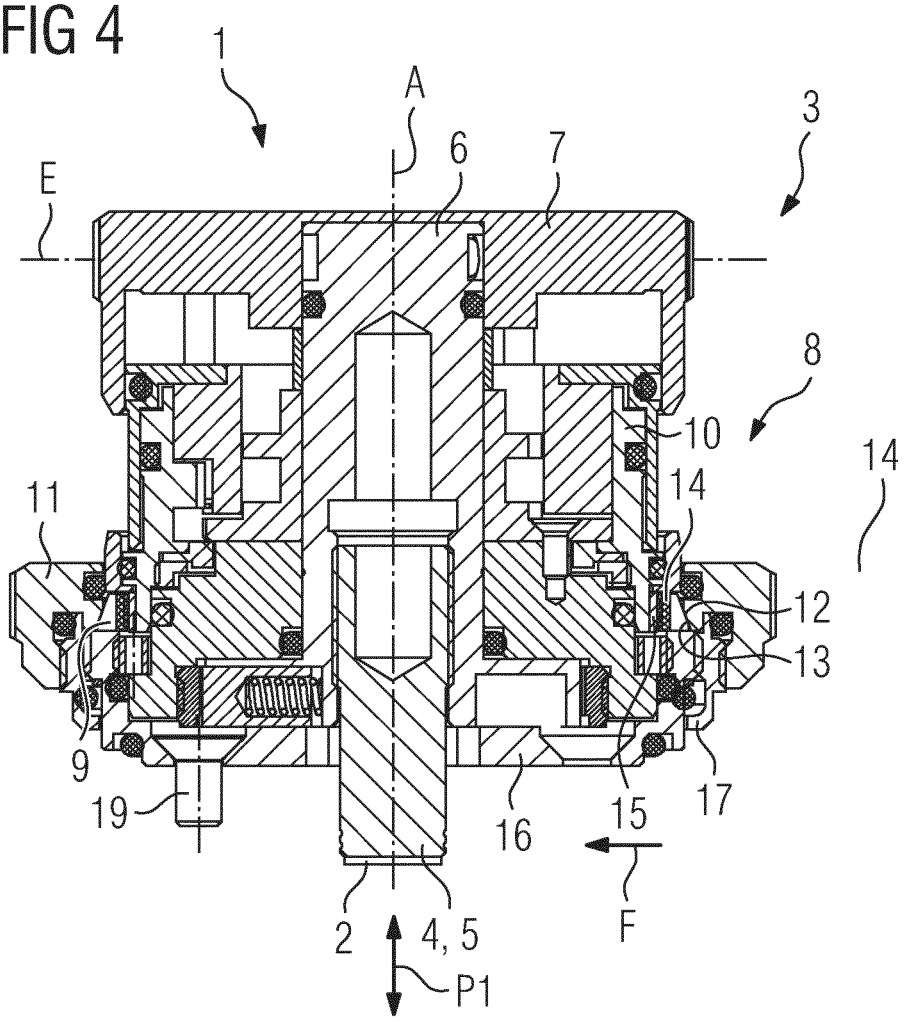

The invention is further disclosed based on exemplary embodiments in the illustrative figures. Shown are in:

FIGS. 1, 2 respectively a perspective representation of a device for adjusting a reticle according to an exemplary embodiment;

FIGS. 3, 4 respectively a sectional view of the device shown in the FIGS. 1, 2.

The FIGS. 1, 2 show respectively a perspective representation of a device 1 for the adjustment of a reticle 2 according to an exemplary embodiment. The FIGS. 3, 4 respectively show a sectional view of the device 1 shown in the FIGS. 1, 2, wherein FIG. 3 shows a sectional view of the device 1 shown in FIG. 1 and FIG. 4 shows a sectional view of the device 1 shown in FIG. 2. Based on the FIGS. 1, 2, it is apparent that the device 1 can be an adjustment turret of an adjustment turret unit or to an integral part of a corresponding adjustment turret unit.

The device 1 includes an adjustable reticle 2, i.e. a target marker, purely schematically indicated in its position, in the FIGS. 3, 4, (relative to a starting or reference position). The adjustable reticle 2 is, in the mounting group of the device 1, arranged, with a long-range optical unit (not shown), i.e. e.g. a telescopic sight means, in an optical channel formed through the optical elements of the long-range optical means. The reticle 2 is adjustable in its position (inside the optical channel), and thusly allows itself to be set to a specified shooting situation, i.e. in particular to a specified distance to target, and an actual hit point connected therewith.

The device 1 includes an adjusting means 3 assigned to the reticle 2. The adjusting means 3 is set up for the adjustment of the reticle 2. The reticle 2 is adjustable, via the adjusting means 3, in a linear movement axis (adjustment axis) indicated through the double arrow P1 show in the FIGS. 3, 4. The adjusting means 3 is configured as an adjusting mechanism which is set up to convert a rotatory movement in to a linear movement adjusting the reticle 2 in the linear movement axis (adjustment axis). Evidently, the linear movement axis coincides with the central axis A defined through the rotationally symmetrical components of the device 1 further described in the following.

The adjusting means 3 includes two components which cooperate in order to adjust the reticle 2. A first component of the adjusting means 3 is a linearly movably mounted adjustment element 4 motion-coupled with a reticle 2. The adjustment element 4 includes a shaft-like adjustment section 5, movable against the reticle 2. An adjustment of the reticle 2 occurs through a movement of the adjustment section 5 against the reticle 2, occurring, if necessary against a return force configured through a suitable return element (not shown), i.e. e.g. a spring element. A second integral part of the adjusting means 3 is formed by a rotatably mounted transfer element 6. The transfer element 6 is coupled with the adjustment element 4 in such a manner that rotational movements of the transfer element 6 are translatable or translated into linear movements of the adjustment element 4, in particular against the reticle 2. The coupling between the transfer element 6 and the adjustment element 4 occurs through mechanical cooperation of transfer-element sided threaded elements (not specified) and adjustment-element sided counter-threaded elements (not specified). The transfer-element sided threaded elements relate to internal threaded sections configured in the region of the inner circumference of a hollow cylindrical transfer element section. The adjustment-element sided counter-threaded elements are external threaded sections configured in the region of the outer circumference of the shaft-like adjustment element section 5.

The adjusting means 3 further includes an adjustment actuation element 7 to be actuated by a user to adjust the reticle 2, movably mounted in an adjustment movement degree of freedom. The adjustment actuation element 7 is co-rotationally coupled with the transfer element 6. The adjustment movement degree of freedom relates to a rotational movement degree of freedom indicated in FIG. 1 through the double arrow P2, upon corresponding actuations of the user therefore to rotational movements. The rotational axis corresponds to the central axis A of the device 1. The adjustment actuation element 7 has a rotationally symmetrical, e.g. an annular-type or ring-shaped basic geometrical shape and is arranged coaxially to other components of the device 1.

A blocking means 8 is assigned to the adjusting means 3. The blocking means 8 is set up for the (temporary) blocking of movements of the adjustment actuation element 7 in the adjustment movement degree of freedom. The blocking means 8 includes a blocking element 9 transferrable in a blocking position shown in FIGS. 2, 4 and in an unblocking position shown in FIGS. 1, 3. The blocking element 9 is movably mounted between the blocking and the unblocking position. In the blocking position, the blocking element 9 acts in such a manner that movements of the adjustment actuation element 7 are blocked in the adjustment movement degree of freedom, more specifically, the blocking element 9, in the blocking position, acts in such a manner upon the adjustment actuation element 7 in such a manner that this element is not movable in the adjustment movement degree of freedom, consequently movement of the adjustment actuation element 7 are not possible. In the unblocking position, the blocking element 9 does not act in such a manner that movements of the adjustment actuation element 7 are blocked in the adjustment movement degree of freedom, more specifically, the blocking element 9, in the unblocking position, does not act on the adjustment actuation element 7 in such a manner that this element is not movable in the adjustment movement degree of freedom, consequently movements of the adjustment actuation element 7 are not possible. The blocking element 9 comprises a rotationally symmetrical, i.e. in particular an annular or ring-shaped basic geometric shape, and is arranged coaxially to other components of the device 1.

The blocking element 9, in the blocking position, cooperates friction-fittingly with the one sleeve-like or -shaped component 10 of the adjusting means 3 co-rotationally coupled or motion-coupled with the adjustment actuation element 7. It would also be conceivable that the blocking element 9 directly cooperates with the adjustment actuation element 7. Through the friction-fitting cooperation of the blocking element 9 with the component 10 of the adjusting means 3 coupled with the adjustment actuation element, movements of the adjustment actuation element 7 in the adjustment movement degree of freedom are blocked in the blocking position. Under a friction-fitting cooperation of the blocking element 9 with the component 10 of the adjusting means 3 coupled with the adjustment actuation element 6, the formation of a frictional force F (see FIG. 4), acting in particular in a radial or circumferential direction with respect to the central axis A of the device 1 on the component 10 of the adjusting means 3 coupled with the adjustment actuation element 7 is to be understood. The frictional force F is so high that these movements of the adjustment actuation element 7 are prevented in the adjustment movement degree of freedom, whereby the reticle 2 is secured in its current position, and undesired adjustments of the reticle 2 are inhibited. It is also, however, conceivable, that the frictional force F makes movements of the adjustment actuation element 7, in the adjustment movement degree of freedom, (significantly) more difficult in comparison to the unblocking position, whereby undesired adjustments of the reticle 2 are similarly suppressed.

The blocking means 8 includes a blocking actuation element 11 to be actuated by a user to transfer the blocking element 9 from the blocking position into the unblocking position, or vice versa, movably mounted in a blocking movement degree of freedom. The blocking movement degree of freedom relates to a rotational movement degree of freedom indicated in FIG. 1 through a double arrow P3, hence to rotational movements in actuations of the user. The rotational axis corresponds to the central axis A of the device 1. The adjustment actuation element 7 comprises a rotationally symmetrical, i.e. in particular an annular-type or ringed-shaped basic geometric form and is arranged coaxially to other components of the device 1.

The blocking actuation element 11 is movably mounted between a first rotational (angle) position and/or a first axial position, respectively with respect to the central axis A of the device 1, which first rotational position or first axial position correlates with the unblocking position of the blocking element 9, and a second rotational (angle) position and/or a second axial position with respect to the central axis A of the device 1, which second rotational position or second axial position correlates with the blocking position of the blocking element 9. The blocking element 9 thus permits itself to be transferred, through movements of the blocking actuation element 11, induced through user-sided actuations, between a first rotational (angle) position and a second rotational (angle) position and/or between a first axial position and a second axial position, in the blocking position or in the unblocking position. The first axial position of the blocking actuation element 11 is represented in the FIGS. 1, 3 showing the unblocking position of the blocking element 9, the second axial position of the blocking actuation element 11 is represented in the FIGS. 2, 4 showing the blocking position of the blocking element 9.

In the exemplary embodiment shown in the Figures, the first axial position of the blocking actuation element 11 represented in FIGS. 1, 3 is an upper position (reference is made here to the exemplary horizontal plane E), and the second axial position of the blocking actuation element 11 represented in FIGS. 2, 4 relates to a lower position. A reversed configuration is, of course, likewise conceivable.

The blocking actuation element 11 includes an effective surface 12, the blocking element 9 includes a counter-effective surface 13. The blocking actuation element sided effective surface 12 is arranged or configured on a section of the inner circumference of the blocking actuation element 11, the blocking element sided counter effective surface 13 is arranged or configured on a section of the outer circumference of the blocking element 9. Based on FIGS. 2, 4, it is evident that the blocking actuation element sided effective surface 12 is configured as a conical surface, i.e. as a conically extending surface, and the blocking element sided counter effective surface 13 is configured as a counter-conical surface (geometrically) corresponding to the conical surface, i.e. as a (geometrically) conically extending surface corresponding to the conically extending surface.

The blocking actuation element sided effective surface 12 cooperates, through movement of the blocking actuation element 11 in the second axial position, with the blocking element sided counter effective surface 13 in such a manner that the blocking element 9 is transferrable or transferred from the unblocking position into the blocking position. The blocking actuation element sided effective surface 12 and the blocking element sided counter effective surface 13 are consequently configured such that that, through their cooperation, a friction-fit or the frictional force F permits itself to be formed. The blocking actuation element sided effective surface 12 is moved, in an actuation of the blocking actuation element 11, to transfer the blocking element 9 into the blocking position, in an axial direction relative to the blocking element sided counter effective surface 13.

The blocking actuation element sided effective surface 12 cooperates, through movement of the blocking actuation element 11 in the second axial position, with the blocking element sided counter effective surface 13 in such a manner that the blocking element 9 is transferrable from the unblocking position into the blocking position, in that the blocking element 9 is or will be moved, in a radially inwardly oriented direction with respect to the central axis A of the device 1, under formation of a frictional fit against the component 10 of the adjusting means 3 coupled with the adjustment actuation element 7. As mentioned, the blocking actuation element sided effective surface 12 is, in an actuation of the blocking actuation element 11, moved, to transfer the blocking element 9 into the blocking position relative to the blocking element sided counter effective surface 13; this relative movement brings about, due to the geometrically constructive conical shape of the effective and counter effective surfaces 12, 13, a radially inwardly oriented movement or deformation of the blocking element 9, with respect to the central axis A of the device 1, against the component 10 of the adjusting means 3 coupled with the adjustment actuation element 7.

The blocking element 9 is expediently configured elastically-resilient or reversibly deformable in radial direction with respect to the central axis A of the device 1, wherein the blocking element 9 is transferrable from a first deformation state correlated with the unblocking position into a second deformation state correlated with the blocking position, in which the blocking element 9, in comparison to the first deformation state, is radially inwardly deformed with respect to the central axis A of the device 1. The elastically resilient or reversibly deformable characteristics of the blocking element 9 are implemented e.g. through a suitable material selection and/or through suitable geometrical-constructive measures, i.e. e.g. the targeted introduction of slits, generally of weakenings.

The blocking element 9 cooperates friction-fittingly, in the blocking position, via a blocking surface element 14 arranged on the blocking element 9 or e.g. formed integrally, with a counter blocking surface element 15 arranged on the component 10 of the of the adjusting means 3 coupled with the adjustment actuation element 7 or, e.g. formed integrally. The blocking element sided blocking surface element 14 is arranged or configured on a section of the inner circumference of the blocking element 9, the component sided counter blocking surface element 15 is arranged or configured on a section of the outer circumference of the component 10. Through the cooperation of the blocking element sided blocking surface element 14 with the component sided counter blocking surface element 15, the actual formation of the frictional force F occurs. Consequently, the blocking element sided blocking surface element 14 and the component sided counter blocking surface element 15 is configured with regards to the formation of the frictional force F.

The blocking surface element 14 is at least sectionally, in particularly completely configured out of an elastomeric, in particular rubber-like material. An embodiment out of a synthetic material or metal would also be conceivable. The counter blocking surface element 15 is, at least in sections, in particularly completely, configured with a friction-increasing surface structure, in particular a knurling structure. A reversed configuration is, of course, likewise conceivable.

The blocking actuation element 11 is mounted on the positionally-fixed mounting element 16 of the device 1 via a coupling element 17, co-rotationally coupled with the same, movably mounted relative to a positionally-fixed mounting element 16 of the device 1, to be considered as a mounting base, between a first axial position with respect to the central axis A of the device 1, which first axial position correlates with the unblocking position of the blocking element 9, and a second axial position with respect to the central axis A of the device 1, which second axial position correlates with the blocking position of the blocking element 9. The coupling element 17 is configured rotation-symmetrically, i.e. in particular in the type or shape of a ring and arranged coaxially to other components of the device 1. The likewise rotation-symmetrically configured blocking actuation element 11 is, in the exemplary embodiment shown in the Figures, arranged co-rotationally coupled to the outer circumference of the coupling element 17.

The mounting element 16 is set up to mount the device 1 to a long-range optical unit, i.e. in particular to a telescopic sight means, and includes, for this purpose, a number of suitable mounting interfaces 18. Corresponding mounting interfaces 18 are, in the exemplary embodiment shown in the Figures, mounting bores 20, penetratable by a mounting element 19, i.e. e.g. a mounting screw.

As depicted in FIGS. 3 and 4, the blocking actuation element 11 can also be movably mounted between a first radial position with respect to a central axis A of the device 1, which first radial position correlates with the unblocking position of the blocking element 9, and a second radial position with respect to the central axis A of the device 1, which second radial position correlates with the blocking position of the blocking element 9. The blocking actuation element 11 can here hence be configured as a radially movably mounted, in particular slider-like blocking element. A first radial position can be a radially external position with respect to the central axis A of the device 1, and a second radial position can be a radially internal position with respect to the central axis A of the device 1. A reversed configuration is, of course, possible.

The invention claimed is:

1. Device (1) for adjusting a reticle (2), comprising:

an adjustable reticle (2), an adjusting means (3), which is set up to adjust the reticle (2), wherein the adjusting means (3) includes an adjustment actuation element (7), movably mounted in an adjustment movement degree of freedom, to be actuated by a user to adjust the reticle (2), a blocking means (8) assigned to the adjusting means (3), which is set up to block movements of the adjustment actuation element (7) in the adjustment movement degree of freedom, wherein the blocking means (8) includes a blocking element (9) transferrable into a blocking position, in which said blocking element acts in such a way that movements of the adjustment actuation element (7) are blocked in the adjustment movement degree of freedom, and into an unblocking position, in which said blocking element acts in such a way that movements of the adjustment actuation element (7) are not blocked in the adjustment movement degree of freedom, characterized in that the blocking element (9), in the blocking position, cooperates friction-fittingly with the adjustment actuation element (7) or with a component (10) of the adjusting means (3) coupled with the adjustment actuation element (7), wherein the blocking means (8) includes a blocking actuation element (11), movably mounted in a blocking movement degree of freedom, to be actuated by the user to transfer the blocking element (9) from the blocking position into the unblocking position, or vice versa, wherein the blocking actuation element (11) is movably mounted between a first radial position with respect to a central axis (A) of the device (1), which first radial position correlates with the unblocking position of the blocking element (9), and a second radial position with respect to the central axis (A) of the device (1), which second radial position correlates with the blocking position of the blocking element (9), and wherein the first radial position is a radially external position with respect to the central axis (A) of the device (1), and the second radial position is a radially internal position with respect to the central axis (A) of the device (1).

2. Device according to claim 1, characterized in that the blocking actuation element (11) is movably mounted between a first rotational position with respect to a central axis (A) of the device (1), which first rotational position correlates with the unblocking position of the blocking element (9), and a second rotational position with respect to the central axis (A) of the device (1), which second rotational position correlates with the blocking position of the blocking element (9).

3. Device according to claim 2, characterized in that the blocking actuation element (11) includes an effective surface (12), and the blocking element (9) includes a counter effective surface (13), wherein the blocking actuation element sided effective surface (12), through movement of the blocking actuation element (11) into the second rotational position and/or into the second axial position and/or into the second radial position, cooperates with the blocking element sided counter effective surface (13) in such a manner that the blocking element (9) is transferrable from the unblocking position into the blocking position.

4. Device according to claim 3, characterized in that the blocking actuation element sided effective surface (12), by moving the blocking actuation element (11) into the second rotational position and/or into the second axial position and/or the second radial position, cooperates with the blocking element sided counter effective surface (13) in such a manner that the blocking element (9) is transferrable from the unblocking position into the blocking position, in that the blocking element (9) is moved in a radial direction with respect to the central axis (A) of the device (1) under formation of a friction-fit against the adjustment actuation element (7) or the component (10) of the adjusting means (3) coupled with the adjustment actuation device (7).

5. Device according to claim 3, characterized in that the blocking actuation element sided effective surface (12) is configured as a conical surface or comprises such a surface, and the blocking element sided counter effective surface (13) is configured as a counter-conical surface corresponding to the conical surface, or comprises such a surface.

6. Device according to claim 1, characterized in that the blocking actuation element (11) is movably mounted between a first axial position with respect to the central axis of the device (1), which first axial position correlates with the unblocking position of the blocking element (9), and a second axial position with respect to the central axis (A) of the device (1), which second axial position correlates with the blocking position of the blocking element (9).

7. Device according to claim 6, characterized in that the first axial position is an upper position with respect to a horizontal plane (E and the second axial position is a lower position with respect to the horizontal plane (E).

8. Device according to claim 1, characterized in that the blocking element (9), in the blocking position, cooperates frictionally via a blocking surface element (14) arranged or formed on the blocking element (9), with a counter blocking surface element (15) arranged or formed on the adjustment actuation element (7) or the component (10) of the adjusting means (1) coupled with the adjustment actuation element (7).

9. Device according to claim 8, characterized in that the blocking surface element (14) arranged or formed on the blocking element (9) is, at least partly configured of an elastomeric material, or a synthetic material or a metal, and that the counter blocking surface element (15) arranged or configured on the adjustment actuation element (7) or the component (10) of the adjusting means (3) coupled with the adjustment actuation device (7) is, at least partly formed with a friction-increasing surface structure.

10. Device according to claim 1, characterized in that a blocking actuation element (11) is mounted on a positionally-fixed mounting element (16) of the device (1) via a coupling element (17), coupled with the blocking actuation element in a rotationally fixed manner, movably mounted relative to the positionally-fixed mounting element (16) of the device (1) between a first axial position with respect to the central axis (A) of the device (1), which first axial position correlates with the unblocking position of the blocking element (9), and a second axial position with respect to the central axis (A) of the device (1), which second axial position correlates with the blocking position of the blocking element (9).

11. Device according to claim 1, characterized in that at least the adjustment actuation element (7), a blocking actuation element (11) and the blocking element (9) respectively are configured rotation-symmetrically and are arranged coaxially with respect to a central axis (a) of the device (1).

12. Long-range optical unit including at least one device (1) for adjusting a reticle according to claim 1.

13. A telescopic sight including at least one device (1) for adjusting a reticle according to claim 1.

14. A device (1) for adjusting a reticle (2), comprising:

an adjustable reticle (2), an adjusting means (3), which is set up to adjust the reticle (2), wherein the adjusting means (3) includes an adjustment actuation element (7), movably mounted in an adjustment movement degree of freedom, to be actuated by a user to adjust the reticle (2), a blocking means (8) assigned to the adjusting means (3), which is set up to block movements of the adjustment actuation element (7) in the adjustment movement degree of freedom, wherein the blocking means (8) includes a blocking element (9) transferrable into a blocking position, in which said blocking element acts in such a way that movements of the adjustment actuation element (7) are blocked in the adjustment movement degree of freedom, and into an unblocking position, in which said blocking element acts in such a way that movements of the adjustment actuation element (7) are not blocked in the adjustment movement degree of freedom, characterized in that the blocking element (9), in the blocking position, cooperates friction-fittingly with the adjustment actuation element (7) or with a component (10) of the adjusting means (3) coupled with the adjustment actuation element (7), and the blocking element (9) is configured reversibly deformable in the radial direction with respect to the central axis (A) of the device (1), wherein the blocking element (9) is transferrable from a first deformation state correlated with the unblocking position into a second deformation state correlated with the blocking position, in which state the blocking element (9) is radially inwardly deformed in comparison to the first deformation state with respect central axis of the device (1).

* * * * *